US006880973B2

(12) United States Patent
Schneider et al.

(10) Patent No.: US 6,880,973 B2
(45) **Date of Patent: *Apr. 19, 2005**

(54) TAMPER EVIDENT RECLOSABLE PACKAGE

(75) Inventors: John H. Schneider, Frankfort, IL (US); Donald L. Crevier, Essex, IL (US); Patricia I. Norek, Mateno, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/963,138

(22) Filed: Sep. 25, 2001

(65) Prior Publication Data

US 2004/0179753 A1 Sep. 16, 2004

(51) Int. Cl.[7] ..... B65D 33/16

(52) U.S. Cl. ..... 383/204; 383/61.2; 383/64; 383/610

(58) Field of Search ..... 383/61.2, 66, 203, 383/204, 210, 211, 64

(56) References Cited

U.S. PATENT DOCUMENTS 4,785,940 A * 11/1988 Wilson ..... 383/204
5,036,645 A * 8/1991 Schwarz ..... 53/412
5,077,064 A * 12/1991 Hustad et al. ..... 426/106
5,121,997 A * 6/1992 La Pierre et al. ..... 383/203
5,246,720 A * 9/1993 Buchko ..... 426/106
5,954,433 A * 9/1999 Yeager ..... 383/203
6,131,369 A * 10/2000 Ausnit ..... 53/412
6,327,837 B1 * 12/2001 Van Erden ..... 53/412

* cited by examiner

*Primary Examiner*—Jes F. Pascua
(74) *Attorney, Agent, or Firm*—Pitney Hardin LLP

(57) ABSTRACT

A tamper evident package has a first wall and a second wall facing the first wall. A zipper is provided at a top of the package. The first and second walls include portions that extend over the zipper and the first wall extension portion has a line of weakness that extends parallel to the zipper. A peel seal joins the first wall and the second wall above the interlocking members of the profiles and sections of the first and second walls extend beyond the peel seal. If the zipper has a slider, a pocket is formed in one of the walls to accommodate the slider. The slider pocket extends parallel to the zipper. Methods of forming he package on various types of form, fill and seal equipment as well as the equipment are also disclosed.

13 Claims, 3 Drawing Sheets

TAMPER EVIDENT RECLOSABLE PACKAGE

BACKGROUND OF THE INVENTION

The present invention relates to reclosable packaging such as plastic bags and, in particular to a tamper evident package and a method of manufacturing such packages on form, fill and seal equipment so as to render the package tamper evident to an ultimate consumer.

Reclosable bags have become increasingly popular both for storage purposes and as primary packaging for foodstuffs and other commodities. The closures for such packaging consist of a pair of profiles having mating interlocking elements and may have webs to facilitate joining the zipper to the package material. A slider may be provided to facilitate opening and closing the zipper. Where the package is to be used to contain food stuffs, it is important to provide the package tamper evident. That is, the consumer should be able to quickly determine, by simple inspection, whether the package has been previously opened since the time it was filled. A common way to provide such tamper evidence is to provide a header of some form extending over the zipper which must be removed before the consumer has access to the zipper. Once the header is removed, the package may be opened and reclosed with the zipper but the removed header provides clear evidence of the initial opening of the package.

When the zipper on such packaging is provided with a slider, it is difficult to provide a header going over the slider without introducing wrinkles or puckers in the package film forming the header. Not only do such wrinkles and puckers waste film, but they also render the packaging untidy.

SUMMARY OF THE INVENTION

The above problems of the prior art are effectively resolved in accordance with the present invention by providing an improved tamper evident package that may readily be modified to accommodate a zipper slider without detracting from the appearance of the package or its ability to provide tamper evidence. The improved reclosable package has a first wall and a second wall facing the first wall. A zipper is provided at a top of the package. The zipper has a first profile attached to the first wall and a second profile attached to the second wall. The first and second profiles respectively have mating first and second interlocking members. The first and second walls include portions that extend over the zipper and the first wall extension portion has a line of weakness that extends parallel to the zipper. The line of weakness may be a line of perforations or a score line extending partially through the package film. A peel seal joins the first wall and the second wall above the interlocking members of the profiles and sections of the first and second walls extend beyond the peel seal. If the zipper has a slider, a pocket is formed in one of the walls to accommodate the slider. The pocket extends parallel to the zipper.

A consumer first opens the package by separating the top peel seal and pulling the wall extensions apart. This action serves to rupture the line of weakness exposing the zipper and providing permanent evidence that the packaging has been opened. The consumer may then rely on the zipper to open and reclose the package as required.

BRIEF DESCRIPTION OF THE DRAWINGS

The present invention is shown in the accompanying drawings wherein.

DETAILED DESCRIPTION OF THE PREFERRED EMBODIMENTS

Figure 1:
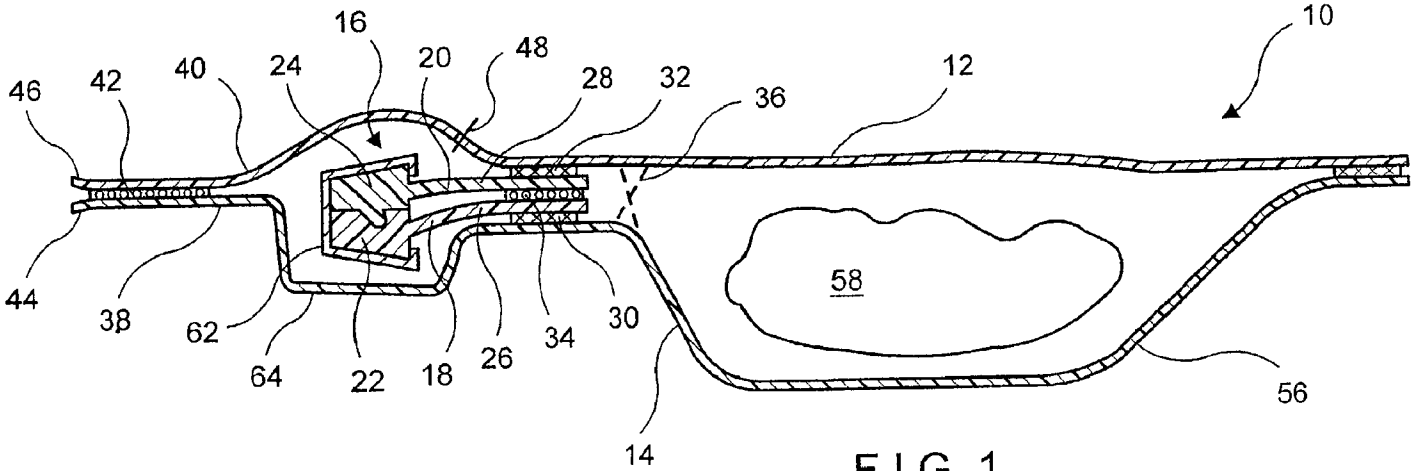
FIG. 1 is a simplified side sectional view of a tamper evident package in accordance with the present invention.
Figure 3:
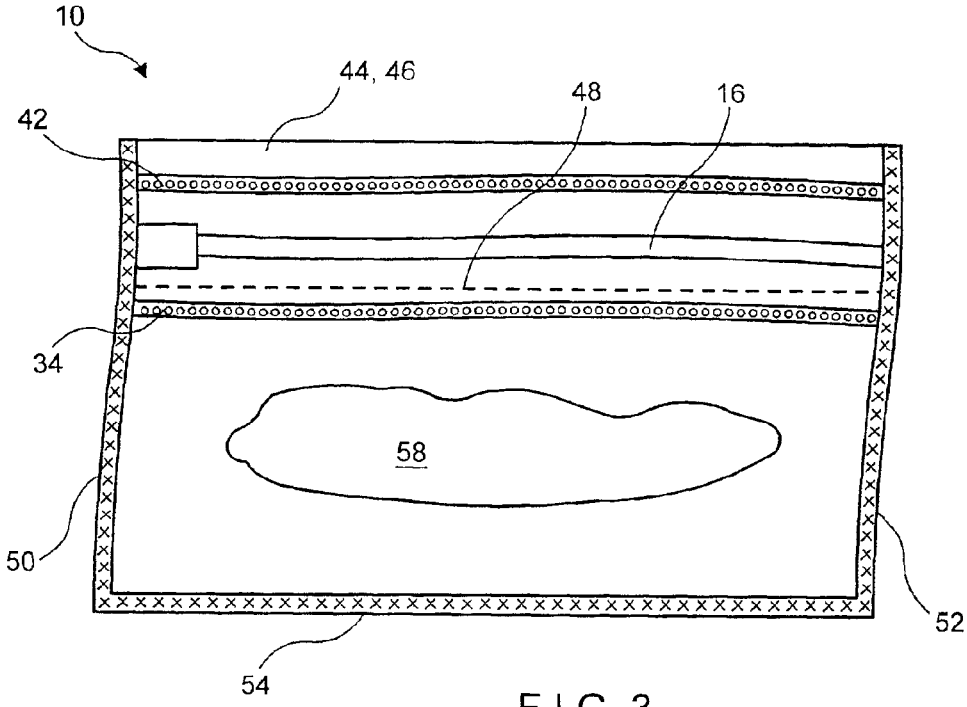
FIG. 3 is a front view of a package in accordance with the present invention, for simplicity, one wall of the package is removed so that the components of the package may be better seen.

Reference is now made to the drawings and to FIGS. 1 and 3 in particular wherein a package 10 in accordance with the present invention is depicted comprising a first wall 12 and second wall 14 respectively forming the front and back of the package. A zipper 16 is provided at the package top. The zipper 16 includes first and second profiles 18 and 20, each of the profiles including mating interlocking members 22, 24 and flanges 26, 28. The exterior surfaces of flanges 26, 28 are sealed to walls 14, 12, respectively by seals 30, 32. A peel seal 36 may be provided joining the interior surfaces of the walls 12, 14 below the flanges 26, 28. Alternatively, the interior surfaces of flanges 26, 28 are sealed to each other by a peel seal 34. The walls of the package include extensions 38, 40 that extend over the zipper. The interior surfaces of the wall extensions are joined to each other by a peel seal 42 with portions 44, 46 of the walls extending beyond the peel seal 42.

The package front wall 12 is formed with a line of weakness 48 in extension 40 above seal 32 and preferably below the interlocking member 24 of profile 20. The line of weakness 48 may comprise a line of perforations or a score line extending partially through the film of wall 12. The package is completed by side seals 50, 52 on opposite sides of the package and a bottom seal 54, if required. If the package front and rear walls are formed of a single, folded sheet, the bottom seal may be replaced by a fold line. The package 10 further includes a thermoformed pocket 56 to contain a product 58.

Figure 2:
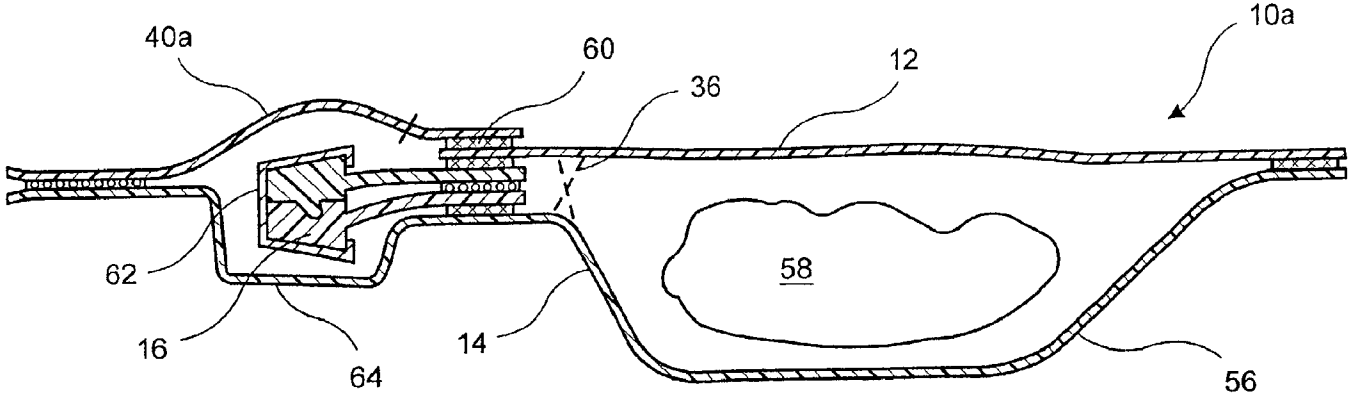
FIG. 2 is a view similar to FIG. 1 showing a modification of the tamper evident package.

The package 10*a* depicted in FIG. 2 is substantially the same as package 10 except that the extension 40*a* comprises a separate strip of film joined by a seal line 60 to the exterior of wall 12. The strip 40*a* may conveniently be printed to form a label for the package.

In both cases the zipper 16 is provided with a slider 62 which rides on the mating interlocking members 22, 24 of the profiles. Movement of the slider in one direction serves to disengage the interlocking members and movement in the opposite direction engages the profiles. The wall 14 is provided with a pocket 64 that extends parallel to the zipper in line with the slider so that the slider 62 seats in the pocket 64.

In use, the consumer grips the top portions 44, 46 of the bag walls and pulls them apart. This causes the peel seal 42 to open and the line of weakness 48 to rupture thereby exposing slider 62. The user may then use slider 62 to open and reclose the zipper 16 to gain access to the package contents.

Figure 4:
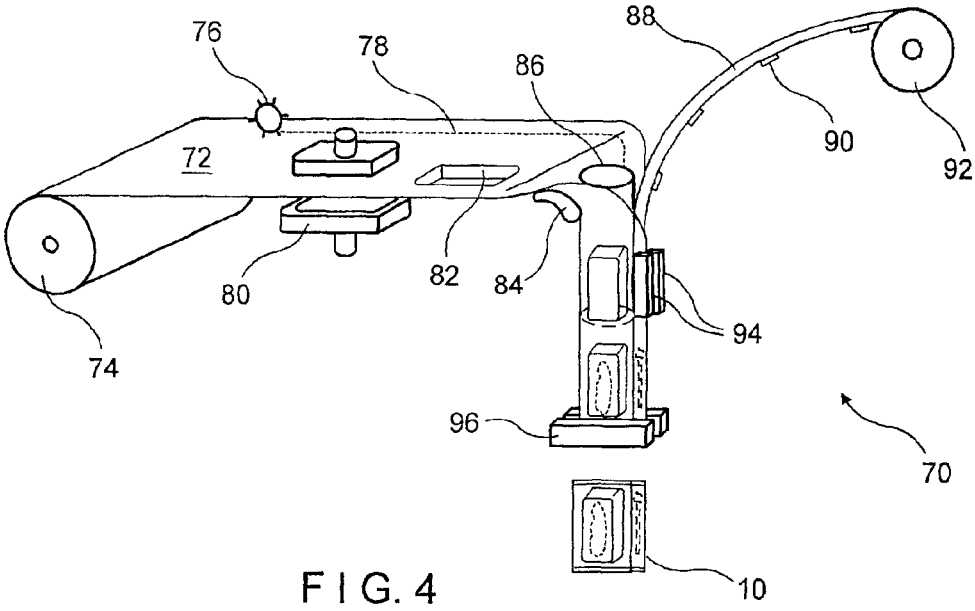
FIG. 4 is a diagrammatic view of a first method for forming a package in accordance the present invention on vertical form, fill and seal (VFFS) equipment.
Figure 5:
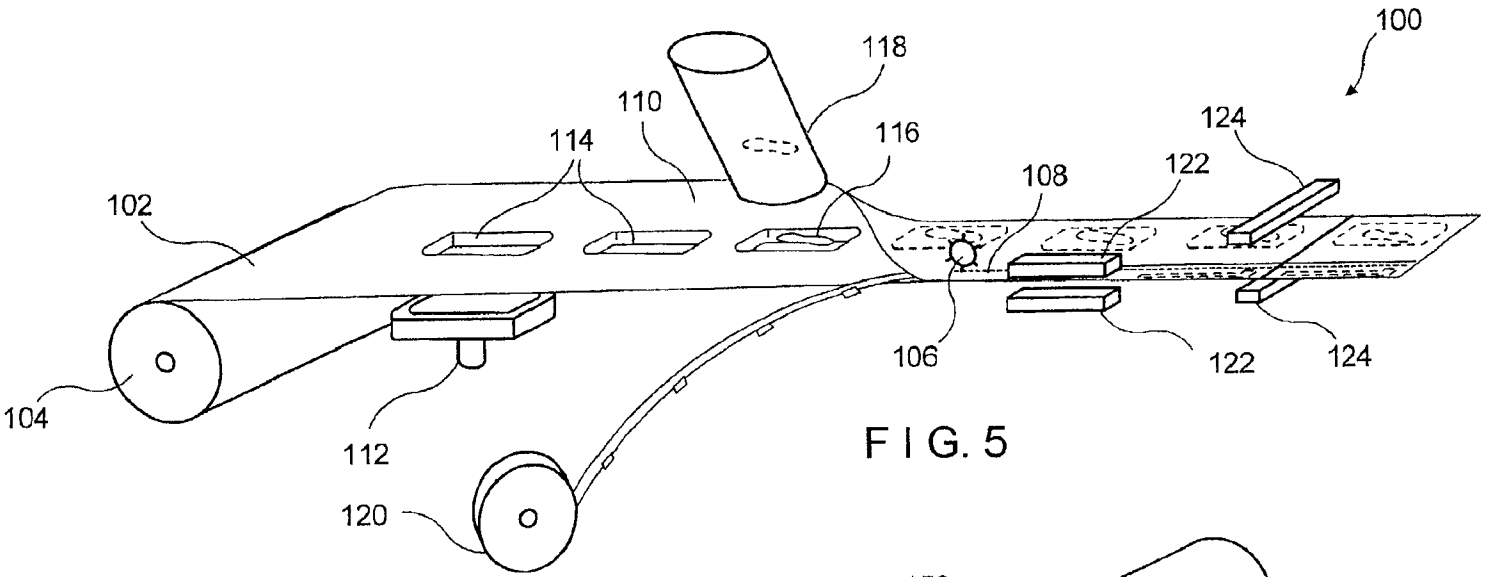
FIG. 5 is a diagrammatic view of a second method for forming a package in accordance the present invention on horizontal form, fill and seal (HFFS) equipment.
Figure 6:
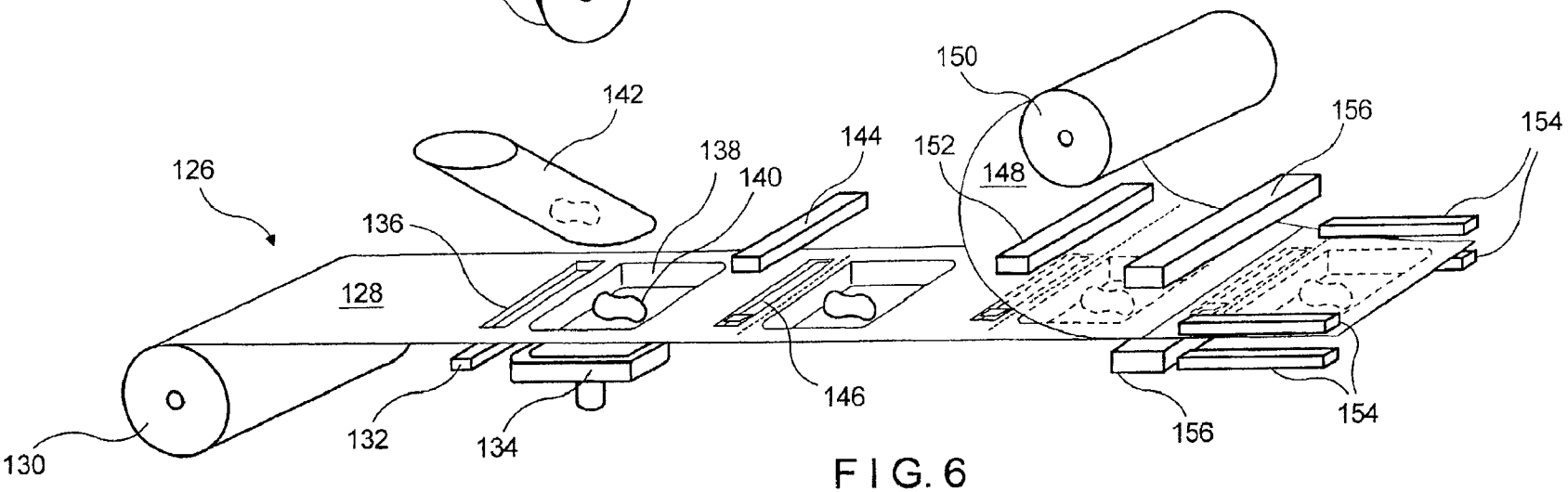
FIG. 6 is a diagrammatic view of a third method for forming a package in accordance the present invention on HFFS equipment.

Reference is now made to FIGS. 4, 5 and 6 wherein representative methods of forming the package 10 are depicted. In FIG. 4 a vertical form, fill and seal machine 70 is depicted. A packaging film 72 is fed from supply roll 74 past a device 76 for forming a line of weakness 78 adjacent but not at a side edge 78 of the film. The device 76 may comprise a serrated wheel for forming a line of perforations. Alternatively, the device 76 could be a laser or other means for scoring the film 72 to form the line of weakness. A pocket forming mechanism 80 is provided at the side of film 72 opposite to the device 76. The pocket forming mechanism could be a vacuum forming die if the film 72 lends itself to vacuum thermoforming. Alternative a plow mechanism could be used to deform the film under the plow into a pocket. In either case, a series of pockets 82 are formed in the film 72 spaced at bag width intervals. The film 72 (now having the line of weakness 78 and pocket 82) is then fed over collar 84 that folds the film about filling tube 86 by bringing the longitudinal edges of the film together in a fin. A zipper 88 with attached sliders 90 is fed from supply 92 into the fin and attached within the fin by sealing bars 94. The sealing bars also serve to activate appropriate coatings on the film (if necessary) to form the peel seals 42, 34 or 36. Longitudinally extending bands of peel seal material may be provided on the packaging film 72 and/or zipper 88 to facilitate forming the peel seals 34 and/or 36 and 42 simultaneously with the attachment of the zipper to the packaging film. The package is then completed by forming transverse seals with sealing bars 96 after being filled through tube 86.

In FIG. 5 a horizontal form, fill and seal machine 100 is depicted for forming a package from a single sheet of film. A packaging film 102 is fed from a supply 104 past a device 106 for forming a line of weakness 108 adjacent but not at a side edge 110 of the film. The device 106 and the line of weakness 108 may be as described above. A pocket forming mechanism 112, as described above, is provided at the opposite side of the film to form a series of slider pockets 114. After a product 116 is fed onto the film from hopper 118, the film is folded over the product bringing the edges substantially together. A zipper 120 with attached slider is fed between the film edges and positioned with a slider in each formed pocket. The zipper is attached by seal bars 122 which also form the package peel seals, as also described above. The package is completed with cross seals formed by seal bars 124.

In FIG. 6 a horizontal form, fill and seal machine 126 is depicted for forming a package from a double sheet of film. The bottom film 128 may conveniently be a thermoform film fed from a supply 130 past heated dies 132 and 134 with which a slider pocket 136 and a product pocket 138 are formed a product 140 is then fed into each product pocket 138 through hopper 142. The bottom film is then fed past a zipper applicator 144 which applies a length of zipper 146 with an attached slider transversely to the bottom film so that the zipper slider is positioned in the slider pocket. A top film 148 is then fed from spool 150 over the bottom film. The top film may be preformed with lines of weakness of the lines of weakness may be formed by device 152 as the top film is fed over the bottom film. In either case, after the top film is positioned over the bottom film, side seals 50, 52 are formed by seal bars 154 and the zipper is attached to the top film by seal bars 156 which also form the package peel seals, as also described above and the package bottom seal 54. While the zipper applicator in this embodiment is shown applying the zipper 146 transverse to the running direction of the films, it should be appreciated that the zipper could readily be applied in the machine direction in the manner described in connection with FIG. 5. That is, the zipper (with attached slider if desired) could be fed onto bottom film 128 before the top film is fed over the bottom film and then sealed to the top and bottom films. The slider pocket would then also be formed as described above in connection with FIG. 5.

Thus, in accordance with the above, the described packages may be effectively formed.

Having thus described he invention, what is claimed is:

1. A reclosable package having a first wall and a second wall;

a zipper at a top of said package, said zipper having a first profile attached to said first wall along an attachment line and a second profile attached to said second wall, said first and second profiles respectively having mating first and second interlocking members, wherein a slider is disposed over said first and second interlocking members for opening and closing said zipper;

said first and second walls including portions extending over said zipper to provide first and second wall extension portions, and wherein said first and second walls are joined at opposite sides of said package by side seals that extend from said top of said package to a bottom of said package;

a first peel seal joining said first wall and said second wall above said interlocking members; and said first wall extension portion having a line of weakness extending parallel to said zipper and positioned between said line of attachment and said first peel seal.

2. The package in accordance with claim 1 where said line of weakness comprises a line of perforations.

3. The package in accordance with claim 1 wherein said first and second walls extend above said first peel seal.

4. The package in accordance with claim 1 further comprising a second peel seal joining said first wall and said second wall below said line of weakness.

5. The package in accordance with claim 4 further comprising a product pocket formed in at least one of said first wall and a second wall below said second peel seal.

6. The package in accordance with claim 1 further comprising a slider pocket formed in at least one of said walls, said slider pocket extending parallel to said zipper and aligned with said slider.

7. The package in accordance with claim 6 wherein said pocket is formed in said second wall.

8. The package in accordance with claim 6 wherein said slider pocket is co-extensive with said zipper.

9. The package in accordance with claim 1 wherein said first and second wall extension portions are formed integrally with said first and second walls.

10. The package in accordance with claim 1 further comprising a produce pocket formed in at least one of said first wall and a second wall below said zipper.

11. The package in accordance with claim 1 wherein said line of weakness is below said first profile interlocking member.

12. A reclosable package having a first wall and a second wall;

a zipper at a top of said package, said zipper having a first profile attached to said first wall and a second profile attached to said second wall, said first and second profiles respectively having mating first and second interlocking members;

said first and second walls including first and second wall extension portions that extend over said zipper, and wherein said first and second walls are joined at opposite sides of said package by side seals that extend from said top of said package to a bottom of said package;

a first peel seal joining said first wall extension and said second wall extension above said interlocking members;

said first wall extension portion having a line of weakness extending parallel to said zipper and positioned between said first peel seal and the points of attachment of said first profile to said first wall and said second profile to said second wall;

a slider disposed over said first and second interlocking members for opening and closing said zipper; and a slider pocket formed in at least one of said walls, said slider pocket extending parallel to said zipper and aligned with said slider.

13. The package in accordance with claim 12 wherein said slider pocket is co-extensive with said zipper.

* * * * *